United States Patent [19]

Pease

[11] Patent Number: 4,634,186

[45] Date of Patent: Jan. 6, 1987

[54] CONTROL SYSTEM FOR LONGWALL SHEARER

[76] Inventor: Robert E. Pease, 8010 Valley Bend Rd., Huntsville, Ala. 35802

[21] Appl. No.: 791,203

[22] Filed: Oct. 24, 1985

[51] Int. Cl.[4] ..... E21C 27/20; E21C 35/08

[52] U.S. Cl. ..... 299/1; 299/42

[58] Field of Search ..... 299/1, 42

[56] References Cited

U.S. PATENT DOCUMENTS

| | | | |
|---|---|---|---|
| 4,120,534 | 10/1978 | Addison | 299/1 |
| 4,371,209 | 2/1983 | Alford et al. | 299/1 |
| 4,531,782 | 7/1985 | Ford et al. | 299/1 |

FOREIGN PATENT DOCUMENTS

| | | | |
|---|---|---|---|
| 2714357 | 11/1977 | Fed. Rep. of Germany | 299/1 |
| 2027548 | 2/1980 | United Kingdom | 299/1 |

*Primary Examiner*—Stephen J. Novosad
*Assistant Examiner*—Michael A. Goodwin
*Attorney, Agent, or Firm*—C. A. Phillips

[57] ABSTRACT

A control system for controlling the elevation of a cutter of a longwall shearer in which the attitude of the body of the shearer and the rate of change of attitude with longitudinal movement of the shearer are monitored and the elevation of the cutter is varied as a function of the sum of the product of a first constant times attitude and the product of a second constant and the rate of change of attitude.

2 Claims, 4 Drawing Figures

+B
-B
H1
H2
62

34
36
54
28
50
REF.
32
18
44
52
42
48
L
B1=0
26
10
38
60
B6
B5
X'
X
R
40
H6
Y5
Y4
Z6
H7
Y6
85
Y4
Z7
REF.
41

CONTROL SYSTEM FOR LONGWALL SHEARER

BACKGROUND OF THE INVENTION

1. Field of the Invention

This invention relates generally to the control of longwall type mining machinery, and particularly to a system for automating the positioning of coal shearing drums whereby an optimum thickness of a coal seam is sheared and smooth controlled cuts obtained.

2. Description of Related Art

As is well known, longwall mining is one of the most productive underground mining methods in use today, employing the most technically advanced mining equipment. In longwall mining, the area to be mined is divided into blocks, typically 500 to 1,000 feet across and 5,000 feet long. Two access tunnels are drilled on either side of the block, and a face tunnel, along a seam of coal, is cut between access tunnels. Roof supports and a track for a longwall coal cutting machine, or longwall shearer, are installed through the face tunnel. The cutting machine makes a cut into the face each time it traverses the track from access tunnel to access tunnel. The cut coal is carried by a conveyor back to an access tunnel for removal. After each traverse of the cutting machine, the roof supports and track are advanced toward the new face of the seam for the next cut. Coal seams mined in this manner are usually in the range of 48 to 144 inches in vertical thickness, with an adjacent region above and below a seam of varied composition. Frequently, the adjacent region is of clay or other unstable material, and for this reason, the tunnel in which the cutting operation occurs is often formed in the coal with an adequate ceiling and floor thickness of coal to maintain the integrity of the tunnel above and below the cutting machine during its pass through the tunnel. As conditions may require, from two the six inches of coal may be left on the ceiling and/or the floor. For example, sufficient thickness of coal on the floor is necessary to support the weight of the shearing machine and roof supports in areas where soft floor materials are prevalent. Alternately, if a greater amount of coal is left than actually required, the economic impact is substantial and can run into the millions of dollars if such deviations persist during significant mining operations. In addition, automated positioning of the cutting drums can result in smoother cuts with less steps, etc., which reduces equipment breakage and maintenance. Also, operating personnel can move away from the cutters, reducing their exposure to coal dust and flying debris.

The obvious problem is how to accurately track and follow a coal seam and its boundaries. If coal seams were level, the task would be relatively simple but they are not. Instead, they largely tend to follow a constantly changing slope and, in fact, in many instances conform to sine waves with amplitudes typically running from 3 to 12 feet and periods of typically 50 to 100 feet. Another and related factor is that the cutting or shearing drums of the cutting machine extend significantly beyond the ends of the machine and cut to the side of the machine and thus form a tunnel for the next pass by the machine. The problems that arise will be appreciated from a brief examination of operation.

Assume first that an initial tunnel is precisely cut between access tunnels along a seam and that it has a known sine wave contour. A track, made of sections generally referred to as pans, is laid through the tunnel beside a face of the seam to be sheared. The shearing machine is then positioned on the track, and its initial task is to make a first cut in the face of the seam, beside the initial tunnel. Ideally, a cutting drum would be set at one elevation to cut either the floor or ceiling of a new cut which is identical with the ceiling or floor elevation of the initial tunnel. Unfortunately, while the machine body is typically supported by its four rollers in the initial tunnel, a cutting drum is in advance of the body of the machine by several feet as it cuts, in effect, a new tunnel. The result is that the elevation of the body is in terms of the slope of the tunnel under it, whereas the cut made by the cutter, to the side of the initial cut, is in advance of the body of the machine. As a result, a single relative position of the drum with respect to the machine will not produce side-by-side like contoured cuts. If one does proceed in a single position of the drum, there will be produced a new cut which will follow a sine wave, but this sine wave will be longitudinally displaced with respect to the sine wave contour of the original tunnel, and it thus will not conform to the coal seam. To make matters worse, actual measurement of the position of the drum with respect to the floor is not possible because of a too-hostile environment for instrumentation.

Because of these factors, it is believed that a practical system for automated control of a longwall shearer has not been devised. As a result, the contour of cutting is simply left up the eye of the operator of the machine, aided by occasional core drillings which spot examine the thickness of coal and guide the operator in adjusting a cut. Experience, however, has shown that these means do not allow an operator to guide the cutting operation under the circumstances described such that efficient and safe operation can be consistently obtained. Accordingly, there remains a very basic need for some form of effective automated aid to remove a significant element of the guesswork which the operator must now engage in in the correction of a longwall cutting machine.

SUMMARY OF THE INVENTION

In accordance with this invention, the inclination of the shearer body and cutter arms with respect to the body are measured as is the traverse of the machine through a tunnel as it makes a cut. From these measurements a rate of change of angle for distance traversed is determined. Additionally, constants relating to the offset position of the cutter with respect to the body of the shearer are determined. One of these is relatively to the shearer slope and the other relative to the rate of change of this slope with respect to distance traversed by the machine. These constants are employed in the generation of an amplitude offset which, when applied to a fixed elevation of a cutter, will replicate the cut on which the machine rides.

As a further feature of the invention, a series of coal thickness sensors are employed, as in the pan track assemblies upon which the shearer rides. During the period that the track is positioned in one position for a face cut, for example, 15 to 20 minutes, these sensors each determine the thickness of the coal at their location. For example, they may be 20 to 50 feet apart. Each reading is compared with a selected thickness and a difference quantity, indicating, by one sign, less thickness than desired or by the other sign, a greater thickness than desired; or, if the comparison provides a zero, then the ideal thickness obtains. The difference figures for the series are typically arranged in some format to determine a smooth curve of cut corrections along the track and these placed in a memory. Then as the machine traverses the track during the next path of the shearer, corrections are taken from the memory corresponding to measured locations and add to or subtract from the elevation of the cutter at that location. This provides an extremely precise control of coal thicknesses left at the ceilings and floors of the coal. At the same time, or if no coal thickness sensors are employed, manual offsets may be entered to readjust the floor or roof elevation if required at discrete locations on subsequent passes.

DETAILED DESCRIPTION OF THE PREFERRED EMBODIMENT

Figure 1:
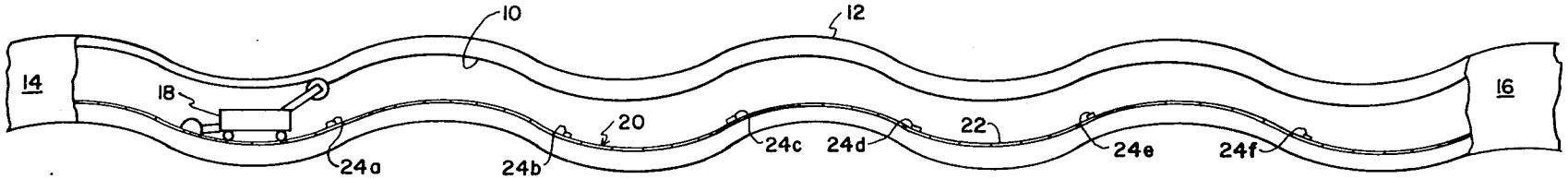
FIG. 1 is a diagrammatic illustration of a portion of a tunnel through and following a seam of coal and showing in place a longwall shearing machine.

Referring initially to FIG. 1, a face tunnel 10 is cut through a seam of coal 12 between access tunnels 14 and 16 to accommodate a longwall coal shearing operation, the longwall extending between the access tunnels and being a longwall of the coal seam. A track 20 formed of 5-foot sections, and referred to as pans 22, are laid on the floor of the tunnel, and as a feature of this invention, a series of coal thickness sensors 24 and also labelled as A–F, are mounted within certain of the pans, being spaced between 20 and 50 feet apart. Six sensors are shown by way of example. Taking note of the fact that a sensing measurement may be taken over the full time that the track is in place, it has been found that a scintallation crystal type radiation sensor, sensing earth background radiation which varies as a function of the thickness of the coal, will provide quite accurate data when permitted to count over such a period.

Figure 2:
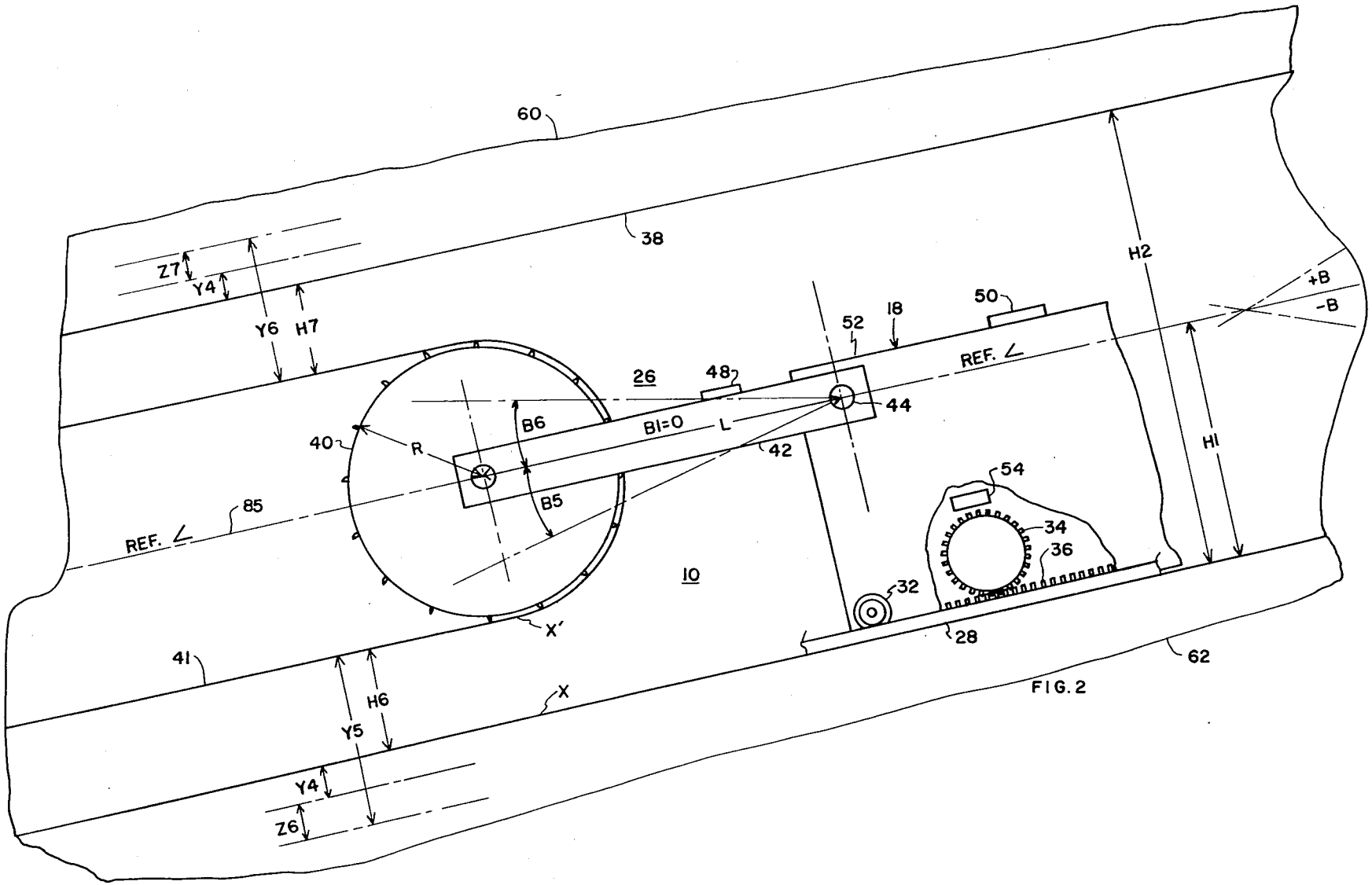
FIG. 2 is a diagrammatic illustration showing as a side elevational view of a portion of a coal shearing machine and certain dimensional measurements and relationships considered by this invention.
Figure 3:
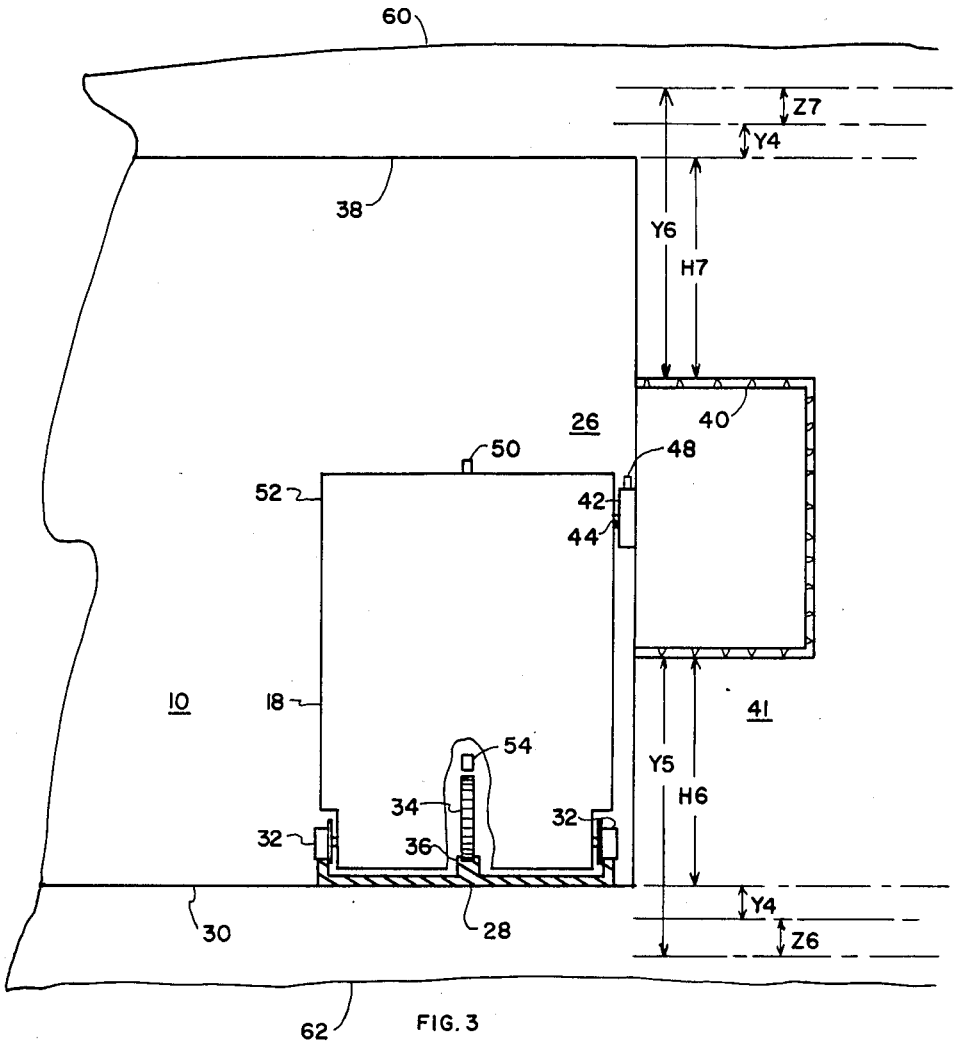
FIG. 3 is a diagrammatic illustration of an end elevational view of the machine shown in FIG. 2.

FIG. 2 illustrates the geometry of a shearing machine 18 with one end portion broken away and thus showing only a single cutter assembly 26. The omission is permissible since an opposite ended cutter would be operated in the same manner and for the further reason that some longwall shearers employ a single cutter, and even those that employ two are often used in a single cutter operation. To examine the geometry of operation, FIG. 3 illustrates, diagrammatically, the position of a pan section 28 which is laid on the floor 30 of tunnel 10. Shearing machine 18 includes rollers 32 which support the machine on pan 28, the machine being driven by a gear or cog wheel 34 powered by a motor (not shown) in machine 18. Cogs of the wheel mesh with a rack 36 in each pan section and thereby the machine is driven along the tunnel. Actually, these structures are shown diagrammatically and would, in fact, be positioned to the side of the assemblies as a coal conveyor is actually operated under machine 18 to remove the coal as it is cut. For purposes of illustration, tunnel 10 is shown as having a ceiling 38. Cutting drum 40 of cutter assembly 26 is rotably mounted on an arm 42 and is rotably driven by means not shown. Such mounting is at one end of arm 42, and arm 42 is pivotally supported at an opposite end by a shaft 44 which is typically rotably driven to raise and lower the opposite end of arm 42 by a hydraulic drive, identified as arm cylinder 46 in FIG. 4. Arm inclinometer 48 is positioned on arm 42 and measures the inclination of the arm with respect to a plane normal to gravity, and an inclinometer 50 is attached to the body 52 of shearer 18, and it measures the inclination of the body of the shearer with respect to a plane normal to gravity. A cog counter 54 is positioned adjacent to wheel 34, and it contains two sensing coils which respond to the passage of a cog or gear and together provide an output indicative of travel of shearer 18 in either direction of travel of machine 18 from a reference count, or zero.

The control system employs a number of parameters which are illustrated in FIGS. 2 and 3. They are listed together with their definition as follows:

T2=shearer location: present cog count reading (1 cog =4.92 in.), as determined from cog count sensor on drive gear T8=previous cog count reading G8=ABS (T2–T8): absolute delta cog count value BO=instantaneous shearer body angle reading B=present average body angle with respect to gravity (degrees) (average of 16 readings in 500 milliseconds), as determined from body inclinometer B8=previous average body angle reading (degrees)

A8=B–B8: delta body angle value (degrees)

I1=A8/G8 body angle rate of change (degrees/cog distance.

H1=height of arm pivot center above floor (in.)

H2=height or distance between floor cut and roof cut (in.)

H6=height of lower cutter edge above floor (in.) when cutter arm angle=zero degrees with respect to shearer body angle H7=height of roof above upper cutter edge when cutter arm angle=zero degrees with respect to body angle Z6=floor cut, cutter height adjustment value (in.)

Z7=roof cut, cutter height adjustment value (in.)

K3=floor profile amplitude compensation factor

K4=floor profile period compensation factor (NOTE: K3 and K4 are emperically determined by simulation program for various floor profiles)

Y4=(K3 * B)+(K4 * I1): delta cut height compensation for floor profile characteristics Y5=(floor cut)=Y4+H6−Z6: required delta height of lower cutter edge below reference Y6=(roof cut)=Y4+H7+Z7: required delta height of upper cutter edge above reference R=cutting drum radius (inches)

L=arm length (distance from arm pivot to drum center) (in.)

B5=SIN(−1) Y5/L: required new arm angle (degrees) if floor cut

B6=SIN(−1) Y6/L: required new arm angle (degrees) if roof cut

B1=present arm angle (degrees) as determined from arm inclinometer

IF B1>(B5+L1), arm too high, adjust down

IF B1>(B5−L1), arm too low, adjust up

Referring again to FIGS. 2 and 3 and the foregoing definitions, it is to be borne in mind that in the sequence of cutting, the machine itself is supported in one tunnel, in this case, tunnel 10, while cutting in a second tunnel beside tunnel 10. Assuming that the first tunnel is correctly cut, it is the goal to make a cut conforming in amplitude and phase with the contour of the first tunnel, taking into account the correctness of the coal thickness of the floor and ceiling of the original tunnel. Thus, if, for example, the original ceiling thickness of coal from ceiling 38 to the outer boundary 60 of the ceiling of the coal seam were two inches and the thickness of the coal between floor 30 and the lower boundary of the seam 62 were approximately six inches, an ideal amount of coal would have been removed when, in all places, the resulting second tunnel is identical to the first one. In controlling cutting drum 40, it is to be kept in mind that one does not have the luxury of actually measuring the distance between cutter 40 and a surface being cut. Thus, the dimensions Y6, H7, Y5, and H6 are not measurable. Measurement is prevented by virtue of there being no known way of locating instruments which make such measurements in the environment. In fact, because of this, the basic problem of control arises. The determination of these referenced dimensions and use by applicant's system provide a most effective control.

Figure 4:
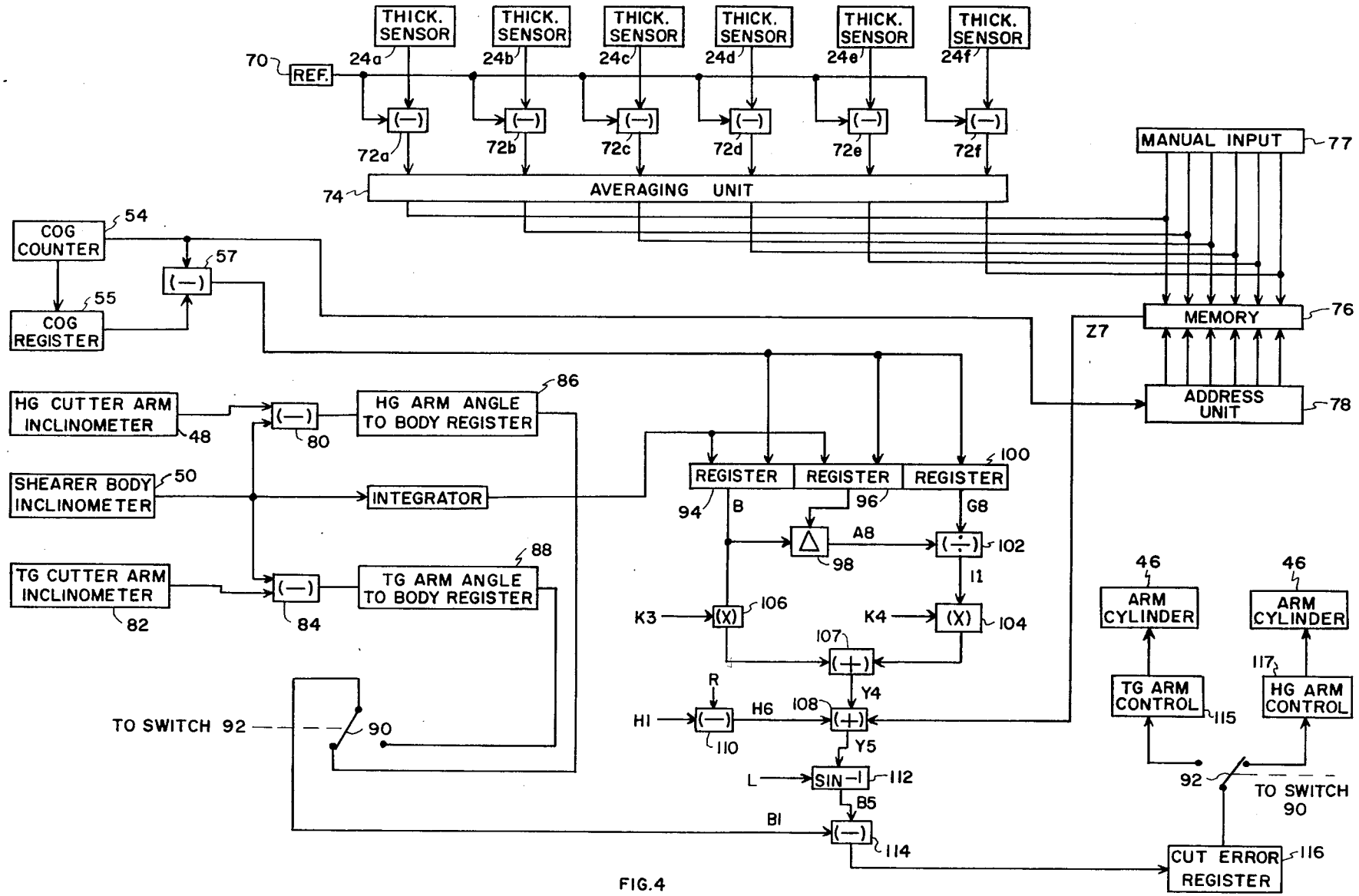
FIG. 4 is an electrical block diagram of the system of this invention.

The electrical system of this invention is particularly illustrated in FIG. 4 in terms of making a floor cut with cutter 40 of cutting machine 18 positioned on a track in tunnel 10 but with cutter 40 making its cut in what will become a new tunnel 41. It will be assumed that coal thickness sensors 24*a*–24*f* are in place as shown in FIG. 1 and that they have provided, as an output, a coal thickness indication at the stations illustrated in FIG. 1. As indicated above, typically the thickness sensors would be positioned 20 to 50 feet apart, being shown by way of example. Further, while the thickness sensors are shown as mounted in the pans of the floor, it is to be anticipated that they also be mounted adjacent a ceiling for the measurement of ceiling coal thickness. Reference unit 70 provides, for example, an output signal indicative of a desired coal thickness, for example, six inches; and this reference is supplied to difference units 72*a*–72*f*. These difference units subtract the desired six-inch reference signal from the coal thickness sensors 24*a*–24*f*. From the difference units, there is provided to signal averaging unit 74 a series of signals representative of thickness errors at the sensor locations. Averaging unit 74 may take a variety of forms. Typically, it would average sets of values, e.g., discrete sets of values being averaged to, in effect, create new values which are plotted by a computer to create points on a smooth or idealized plot of error versus machine position. Then, as desired, values would be sampled which are representative of error values (from the curve) either at the discrete points of measurement or in between. Instead of providing six outputs as shown, there may be a hundred outputs providing a thickness correction at intervals of one hundredth of the distance between access tunnels 14 and 16. For simplicity of illustration, the same number of outputs, as inputs to averaging unit 74, are shown, these being supplied to a memory 76. Alternately as shown, an operator may, by means of a conventional bank of potentiometers or switch controlled digital display/counters, enter corrective thickness inputs as illustrated by manual input 77.

The readout of thickness corrections is, of course, in terms of position along track or pan 28 and to enable this, a position signal, representative of the position of machine 18, is fed to address unit 78 from cog counter 54. Address unit 78 is conventional in that, upon the receipt of an address signal from cog counter 54, it interrogates a memory position of memory 76 corresponding to an error signal which is provided as an output Z7 as a coal thickness error existing at a discrete distance along pan or track 28 corresponding to a coordinated value as obtained from averaging unit 74.

Assuming that cutter 40 is the head gate (H.G.) cutter of machine 18, inclinometer 48 provides a signal output to difference unit 80 indicative of the inclination of arm 42 (FIG. 2) and, although not otherwise illustrated, an identical cutter arm inclinometer 82 is mounted to an identical arm on the opposite end of machine 18 as is a tail gate (T.G.) cutter arm inclinometer. Inclinometer 48 provides an electrical output indicative of the cutter arm inclination (with respect to a plane normal to gravity) to difference unit 84. Body inclinometer 50 provides an output indicative of the inclination or attitude of shearer 18 (also with respect to a plane normal to gravity) as a second input to each of difference units 80 and 84. The outputs of difference units 80 and 84, being the difference in slope or angle of the cutter arms and body, provide relative angle outputs, that is, difference unit 80 provides as an output a signal representative of the angle that arm 42 makes with reference line 85 which passes through the center of shaft 44 and a like shaft pivotally holding the arm of the tail gate cutter. Difference unit 84 provides the same output with respect to a tail gate arm. For purposes of illustration, the angular inputs are indicated as being available from registers 86 and 88, fed respectively from difference units 80 and 84. The outputs of registers 86 and 88 are provided to selector switch 90, which is shown as a means of illustrating that alternate values to be processed further would derive either from register 86 or register 88 and would be employed as illustrated by selector switch 92 ganged with switch 90 to control arm cylinders controlling the angular position of either the head gate or tail gate cutter arms. Again, for purposes of illustration, the operation of the system is described in terms of the control of cutter assembly 26 to make a floor cut (a ceiling cut would be similarly controlled). The system, of course, will operate in a like manner to control the opposite or tail gate cutter arm assembly in either a ceiling or floor cutting control mode.

To examine the employment of the signal outputs of the cutter and shearer body inclinometers, at this point it is well to state that a basic function of the system is to control the relationship of the angle of the cutter arm to its support platform, namely machine 18, and to do this while the attitude of the support changes. We do make the assumption that this change follows the coal seam in a sinusoidal pattern as illustrated in FIG. 1 and particularly that the attitude of the platform and rate of change of it follows the floor of the tunnel to provide identity data as to discrete points on a sine wave having the amplitude and period of the one shown for tunnel 10. Thus with this, it was determined there should be a translation factor or factors, including the factor identified here as K3 and K4, which, when applied to the attitude and rate of change of it (with distance) at a point on the floor of tunnel 10, would define the difference in position of a point of engagement, e.g., a roller 32 of machine 18 and the point of engagement X′ of a cutting drum 40, for example, cutting drum 40, with a point X on the floor, which point is an intersection of a line parallel with the rollers of machine 18 (only roller 32 at one end is shown, but a similar roller would be visible at the same distance from reference line 86 at an opposite end of machine 18) and a vertical line extending through the center of drum 40. In any event, it is to be appreciated that point X' on drum 40, or where it engages the floor, is at the end of a moment arm from roller 32, and thus it is to be appreciated that point x' will not track and ride along the floor of the seam making up tunnel 41. However, it will conform to a sine wave, but its period and amplitude will vary as a result of the moment arm.

These phase and amplitude differences between the cutter and the sinusoidal floor profile constitute the principal error to the desired cut, namely, a cut which will match the previous cut upon which the shearer and its track now rest. This error can now be cancelled by using derived constants K3 and K4 in conjunction with the measured body pitch angle and its rate of change. The resulting computation has been described previously as Y4, "delta height compensation factor for floor profile." An example of the determination of K3 and K4 factors follows, using typical shearer geometry and typical seam profile data (determined by previous observation of the mine site):

SHEARER GEOMETRY

Physical Measurements:

1. C/L (center line) to C/O of forward (head gate) and rear (tail gate) rollers=105 in.
2. C/L rear roller to tail gate cutter drum C/L=114 in.
3. C/L front roller to head gate cutter drum C/L=114 in.
4. C/L tail gate and head gate arm pivots to cutter drums C/L=75 in.
5. Cutter drum diameter=57 in.; radius=28.5 in.
6. Height of arm pivots C/L above floor=38.4 in.

COAL SEAM GEOMETRY

Sinusoidal period=240 cogs, or 1180.8 in. or 98.4 ft.
Sinusoidal amplitude (peak to peak)=124 in. or 10.3 ft. or ±3 degrees maximum body angle Procedure:

1. Computer simulation program calculates resulting floor cut of machine traveling on track having the given sinusoidal parameters. Cutter arm is assumed fixed so as to provide a cut even with present floor, if floor were flat and level.
2. On a sinusoidal floor, the motion of the cutter because of machine ± pitching will produce a sinusoidal cut which is out of phase with the floor. This error, it is noted, is equal to the amount of ± cutter elevation adjustment required. This parameter is called E4.

$$Y4=K3*B(\text{body angle})+K4*I1\ (\text{body angle rate})$$

3. The values of K3 and K4 are selected and substituted in the computer simulation equations until Y4=E4 or until Y4=E4+X.
   Where X=delta inches of coal to be trimmed off the top of the hills and delta inches of coal to be filled at the bottom or valleys.
   The latter procedure is done if the mine operator desires a smoother floor cut than that which would occur by following the natural seam boundary.
4. For the geometry and seam conditions described previously and where X=1.5 inches:

$$K3=0.10;\ K4=60$$

As stated, one of the factors dealt with by the system is the slope or incline of shearer 18, and it is obtained from shearer body inclinometer 50. In order to insure accuracy, a series of inclinometer readings are taken and integrated or averaged over a period of approximately one second. These are sequentially stored each time the machine traverses a selected distance. Distances are obtained from cog counter 54, and incremental distances between sampled inclinometer readings are obtained by storing a cog count in cog register 55 until a new count output of cog counter 54 occurs. Thus, there is provided to difference unit 57 two counts which enable it to provide an output indicative of the distance covered between counts. This distance value is supplied and stored in register 100. The inclinometer readings are also sequentially obtained and stored at the same rate in registers 94 and 96 so that there is the present angle stored, for example, in register 94 and the last previous angle stored in register 96 and concurrently the distance traveled between the registering of these angles stored in register 100. The outputs are coordinated by triggering angular inputs into registers 94 and 96 by an output or trigger output of difference unit 57 as it outputs to register 100. The difference between the outputs of registers 94 and 96 are obtained as A8 by difference unit 98 and supplied to devider 102, which is also supplied the G8 output of register 100. Thus, this value, G8, when divided by divider 102 into the angular change A8 output, provides an output I1 which is a signal indicative of the rate of change of slope of machine 18 for a discrete distance travelled by the machine. This value is supplied to multiplier 104. An angular output B of, for example, register 94, is indicative of the then slope of machine 18 and is fed to multipler 106 to which is also fed the constant K3. The outputs of multipliers 104 and 106 are summed in adding unit 106 to provide as an output the desired elevational distance Y4, representative of the offset or correction position to cause cutter 40 to be in a correct cutting position to cut an identical and in-phase sine wave pattern to that formed by tunnel 10 in which machine 18 is supported and runs.

As described above, means are also provided to make a cutting correction to deal with thickness errors of tunnel 10, and these are in the form of a signal Z7 from memory 76. In essense, it applies a correction to a replica of tunnel 41 at a discrete point along the tunnel in its determination of a new cut. A signal Z7 thus would be added or subtracted to a signal Y4 depending upon the relative signs of the signals to either increase or decrease the depth of cut as indicated by the nature of correction desired. This summing function is accomplished by adder 108. In addition, however, in order to provide an absolute elevational control signal and with reference to FIG. 2 with respect to a floor cut, the additional dimensional factors H1 and R are necessary to provide a cut up to the desired final floor position indicated at the bottom as dimension Z6. Thus, subtraction unit 110 effects a subtraction between the terms H1 and R to provide the additional element H6 which would be then added by adding unit 108 to factors Y4 and Z6 to provide a final elevational dimension for a cut indicated at Y7. Arc sine unit 112 then receives the quantity Y5 and arm length L of arm 42 and provides as an output angle B5 which is the angular position of arm 42 to cause drum 40 to cut downward to a floor position indicated at the bottom of dimension Z6.

The actual instantaneous position of arm 42 would be that in head gate arm to body angle register 86. This would be supplied by a register 86 through switch 90 as angle B1 to difference unit 114 to thus provide an electric output indicative of the change that would need to be made in the angle of arm 42 to finally effect the indicated cut. This value is stored in cut error register 116 and is supplied through switch 92 to a head gate arm control unit 117 which then applies a selected hydraulic input and pressure to hydraulic cylinder 46 until angles B1 and B6 are identical, at which time hydraulic pressure would be removed or otherwise controlled to cause arm cylinder 46 to be raised to make another cut. Alternately, tail gate control would be effected through ganged switches 90 and 92 to tail gate arm control 115.

It is to be appreciated that the same approach would be employed to make roof cuts, it only being necessary to provide the correct sign as to corrections and certain other parameters. Thus, the input to adder 108 would be H7, which is equal to H1+H2, and the output of adder 108 would be Y6 instead of Y5 as these terms are illustrated in FIG. 4.

It is to be further appreciated that the control system shown in FIG. 4 may be programmed into a general purpose, or special purpose, computer to perform the functions illustrated by a serial signal system rather than parallel as shown.

The invention claimed is:

1. A control system for a longwall coal shearer assembly, said shear assembly comprising a track positionable in a tunnel along a seam of coal having a generally sine wave contour and a shearing machine adapted to move along said track, said shearing machine including a body having a longitudinal reference, a shearing drum, and an arm pivotally supported at one end on an end region of said body, with an opposite end of said arm extending beyond said body, a driven shearing drum rotably attached to said opposite end of said arm, and means responsive to control signals for rotating said arm whereby said drum is varied in elevation, said system comprising:

first inclination means supported by said body for providing first electrical signals representative of the inclination of said longitudinal reference of said shearer with respect to a horizontal line perpendicular to gravity;

second inclination means for providing second electrical signals representative of the inclination of said arm with respect to said longitudinal reference;

sensing means responsive to the movement of said body along said track for providing third electrical signals representative of the movement of said shearer along said track;

first computational means responsive to first and third signals for providing, as fourth signals, signals representative of changes of said first signals in relation to changes of said third signals;

second computational means responsive to the sum of a first constant times said first signals and a second constant times said fourth signals for providing fifth signals representative of the difference in the elevation of said shearing drum from a sine wave elevational contour formed by said track and when maintained at a fixed elevation as said shearer traverses said track; and control means responsive to said fifth signals and said second signals for providing said control signals to said means for rotating said arm and controlling the elevation of said drum.

2. A control system as set forth in claim 1 further comprising:

a plurality of coal thickness sensors positioned along a wall of a tunnel through which said track extends;

memory means responsive to said thickness sensors for storing a plurality of signals which are a function of the thickness of coal adjoining said tunnel along said tunnel; and said control means includes means responsive to said last-named signals, said fifth signals and said second signals for providing said control signal to said means for rotating said drum for controlling the elevation of said drum by a factor which includes a deviation from the thickness of the coal in said tunnel proximate to the point of operation of said drum.

* * * * *